United States Patent [19]

Lawrence

[11] 4,033,060

[45] July 5, 1977

[54] PICTURE FRAME CONSTRUCTION

[76] Inventor: Simone P. Lawrence, 33 E. 22nd St., New York, N.Y. 10010

[22] Filed: Mar. 8, 1976

[21] Appl. No.: 654,958

Related U.S. Application Data

[63] Continuation-in-part of Ser. No. 607,124, Aug. 25, 1975, abandoned.

[52] U.S. Cl. ..... 40/152.1; 40/124.1; 40/154

[51] Int. Cl.[2] ..... G09F 1/12

[58] Field of Search ..... 40/154, 152.1, 156, 40/152, 155, 158 R, 158 B, 158 A, 124.1, 126 A

[56] References Cited

UNITED STATES PATENTS

| | | | |
|---|---|---|---|
| 1,589,948 | 4/1926 | Degginger | 40/152.1 |
| 1,940,328 | 12/1933 | Schrotenboer | 40/152 X |
| 2,647,834 | 8/1953 | Rabkin et al. | 40/154 X |
| 3,053,001 | 9/1962 | Allen | 40/154 |
| 3,341,961 | 9/1967 | Shanks | 40/158 R |
| 3,355,828 | 12/1967 | Betz | 40/124.1 X |
| 3,664,049 | 5/1972 | Smith | 40/154 |
| 3,707,053 | 12/1972 | Itano | 40/158 R |
| 3,745,680 | 7/1973 | Faust | 40/156 |
| 3,782,015 | 1/1974 | Esry | 40/154 X |
| 3,837,987 | 9/1974 | Williams et al. | 40/152.1 |
| 3,918,187 | 11/1975 | Vogele | 40/152.1 X |
| 3,928,931 | 12/1975 | Slemmons | 40/152.1 |

*Primary Examiner*—John F. Pitrelli
*Attorney, Agent, or Firm*—Charles E. Temko

[57] ABSTRACT

A low cost picture frame construction particularly adapted for displaying photographic prints and the like of standard sizes upon a wall or other vertical surface in such manner that the print is spaced a substantial distance from said surface to provide an impression of substantial depth. The frame includes three elements, an outwardmost element being of lightweight paper coated with a synthetic resinous material, a second element and a third element being formed of heavyweight paper. The second element includes foldable flaps or tabs which serve a joint function of retaining the device in assembled condition and spacing said first element from said wall.

9 Claims, 14 Drawing Figures

FIG. 10
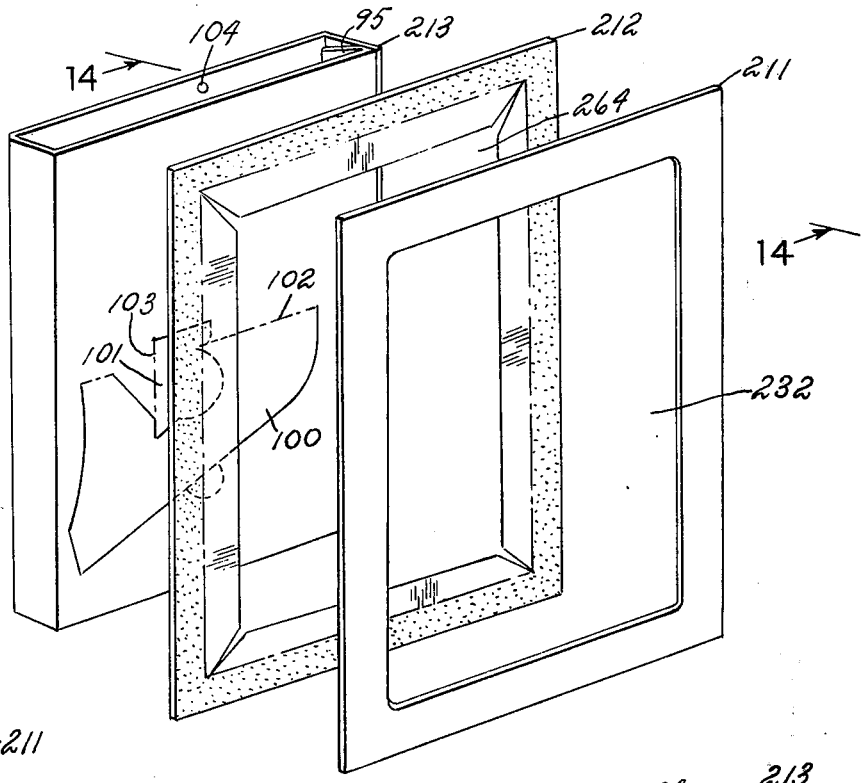
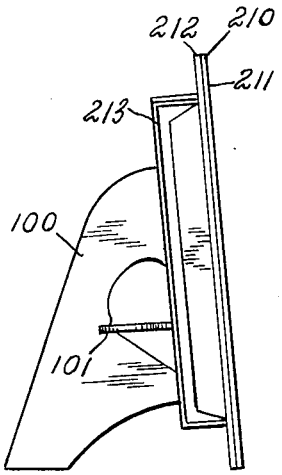
FIG. 13
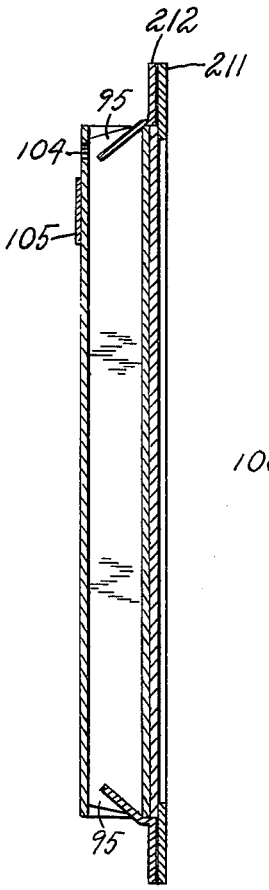
FIG. 14
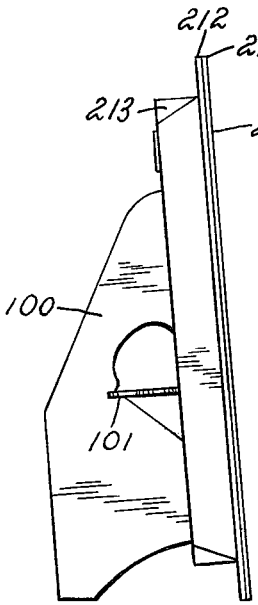
FIG. 12
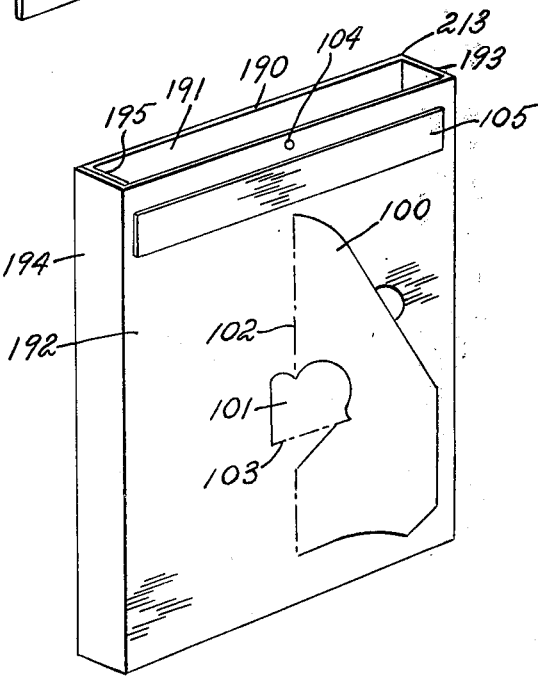
FIG. 11

PICTURE FRAME CONSTRUCTION

RELATED APPLICATION

This application is a Continuation in Part of my copending Application Ser. No. 607,124 filed Aug. 25, 1975, now abandoned under the same title.

BACKGROUND OF THE INVENTION

Picture frames and folders of various types known in the art have been formed from paper and pasteboard elements. Many of these devices include a rearwardly extending flap-like appendage enabling them to be supported in erect, near vertical condition upon a horizontal surface. Most frames adapted for suspension on a wall or other vertical surface have included either a wood, metal of synthetic resinous frame, and a pair of planar panels, an outer one of which is transparent, and an inner one of which is maintained in congruent relation therewith to support a picture or print therebetween.

SUMMARY OF THE INVENTION

Briefly stated, the invention contemplates the provision of an improved frame construction of the type described adapted to be mounted upon a wall or other vertical surface solely by adhesive means made possible by the very low total weight of the device. As the device is made principally of laminated paper and paper-like materials as a result of die cutting operations, and associated heat sealing of thin synthetic resinous materials, the total cost of fabrication is of a very low order.

BRIEF DESCRIPTION OF THE DRAWING

In the drawing, to which reference will be made in the specification, similar reference characters have been employed to designate corresponding parts throughout the several views.

FIG. 10 is an exploded view in perspective of a third embodiment of the invention.

FIG. 11 is a rear view in perspective showing the sides opposite that seen in FIG. 10.

FIG. 12 is a side elevational view of a fully assembled third embodiment.

FIG. 13 is a side elevational view corresponding to that seen in FIG. 12, with certain of the component parts in altered relative position.

FIG. 14 is a vertical sectional view as seen from the plane 14—14 in FIG. 10.

DETAILED DESCRIPTION OF THE DISCLOSED EMBODIMENT

Figure 1:
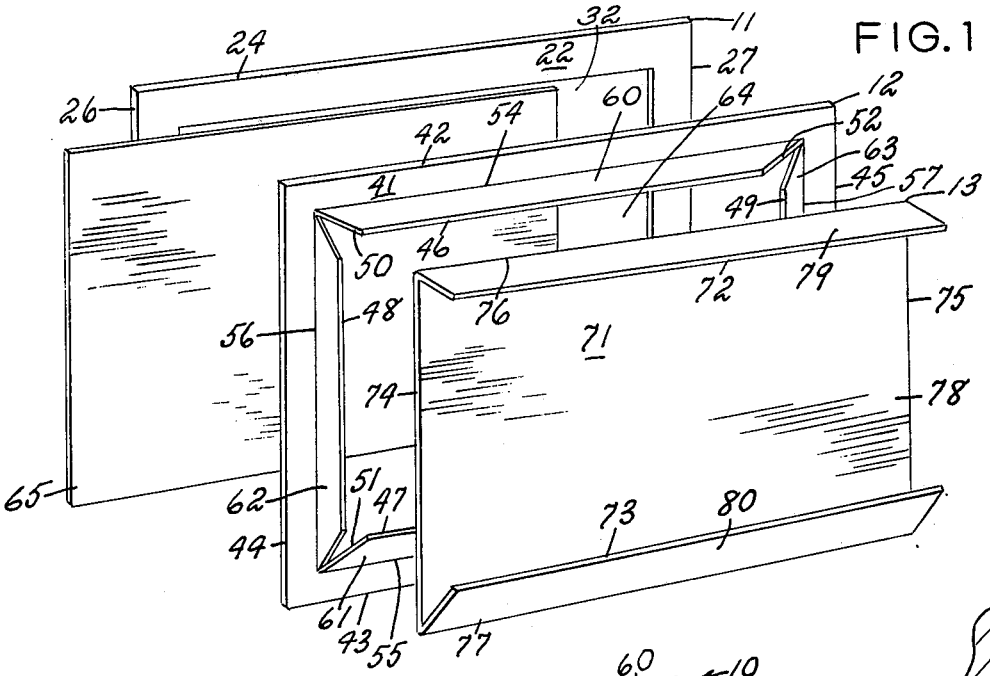
FIG. 1 is an exploded view in perspective of an embodiment of the invention.
Figure 2:
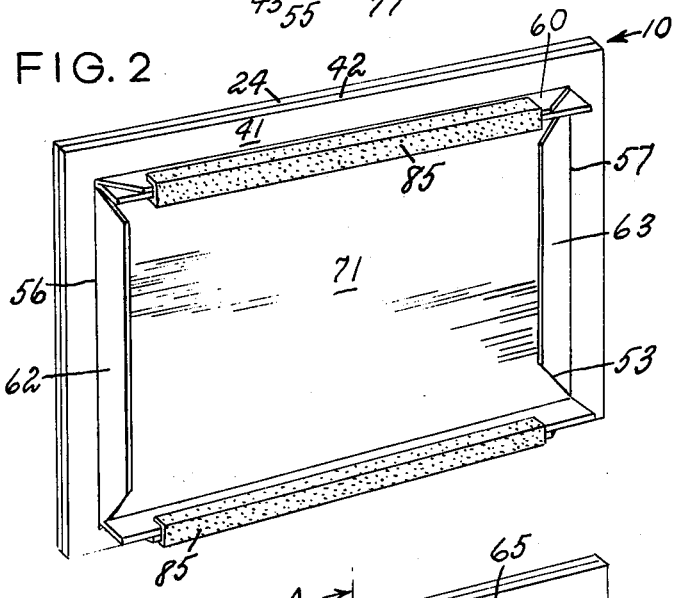
FIG. 2 is a similar view in perspective showing the device in assembled condition.

In accordance with the first embodiment of the invention, the device, generally indicated by reference character 10, comprises broadly: an outer frame element 11, an inner frame element 12 and a picture retaining element 13.

The outer frame element 11 may be formed from paper stock, but is preferably of thin synthetic resinous material such as polyvinylchloride, polystyrene or the like. It is bounded by a forward surface 21, a rearward surface 22, which, in the case of paper construction may be provided with a suitable adhesive (not shown). Where the element is formed of synthetic resinous materials, it is heat sealed directly to the inner frame element 12. The element includes outer side peripheral edges 24 and 25, outer end peripheral edges 26 and 27 and inner peripheral side and end edges 28, 29, 30 and 31 defining an opening 32 therebetween.

The inner frame element 12 is formed of heavyweight paper or lightweight pasteborad. It is bounded by a forward surface 40, a rearward surface 41 and outer peripheral side and end edges 42, 43, 44 and 45 which in assembled condition are in congruent relation with respect to the edges 23–27, inclusive, of the outer frame element 11. Inner peripheral side and end edges 46, 47, 48 and 49 intersect with angularly disposed edges 50, 51, 52 and 53 terminating at opposite ends at the intersection of embossed fold lines 54, 55, 56 and 57. Inwardly disposed portions are bent about the fold lines 54–57 to form trapezoidally-shaped flaps 60, 61, 62 and 63 and define an opening 64 corresponding in dimensions to that of a print or picture 65 to be displayed. It will be observed that the opening 64 while generally congruent with respect to the opening 32 is slightly larger, so that when the print is positioned within the opening 64, it will not pass through the opening 32 which forms a margin therearound.

The picture retaining element 13 is also formed from heavyweight paper. It is generally rectangularly shaped and bounded by a forward surface 70, a rearward surface 71, side edges 72 and 73, as well as end edges 74 and 75. Parallel fold lines 76 and 77 separate a main body portion 78 from elongated flaps 79 and 80.

Figure 4:
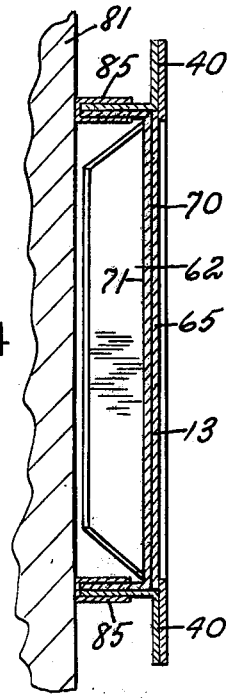
FIG. 4 is an enlarged vertical sectional view as seen from the plane 4—4 in FIG. 3, and showing the device in installed condition upon a vertical surface.
Figure 3:
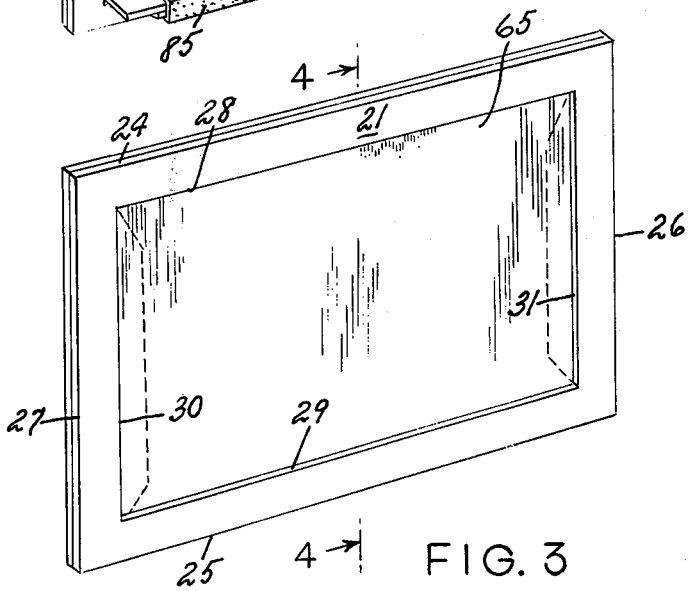
FIG. 3 is a view in perspective as seen from the rear of FIG. 2.
Figure 5:
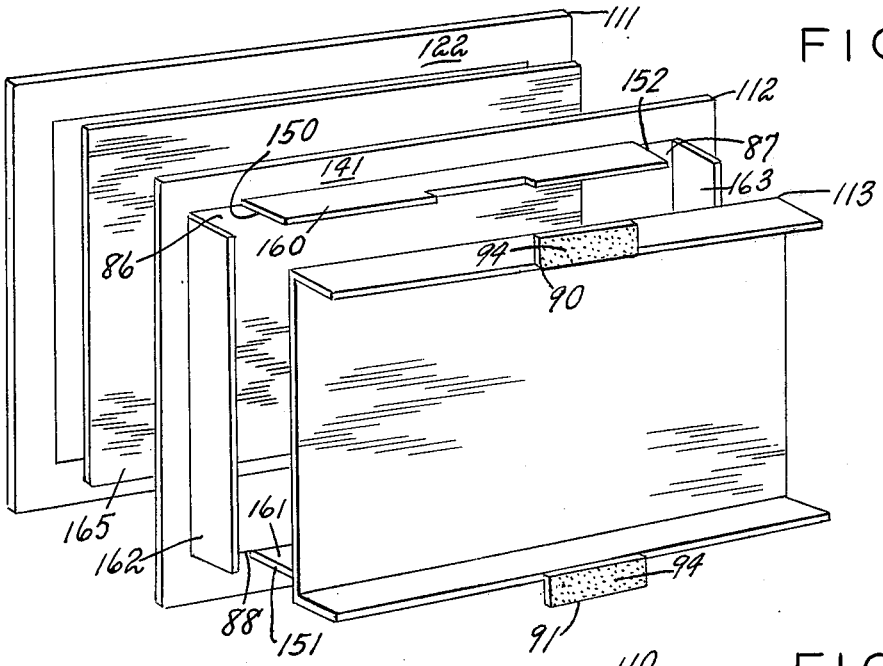
FIG. 5 is an exploded view in perspective of a second embodiment of the invention.

The device will normally be manufactured with the outer and inner frame elements 11 and 12 in integrated condition, either by means of glueing or heat-sealing operation, and with both these integrated elements and the picture retaining element in planar condition. To use the device, it is necessary for the user only to rearwardly fold the flaps 60–63 and insert the print 65 as shown in FIG. 4. The print is retained in position by folding rearwardly the flaps 79 and 80, and inserting the element 13 into the interstice between the flaps 60–63, whereby the flaps 79 and 80 are placed in congruent relation with respect to the inner surfaces of the flaps 60 and 61, respectively. This enables the inner surface of the main body portion 78 to press against the rear surface of the print 65 and urge it into planar condition behind the opening 32. As the flaps 62–63 will exert a tendency to return to their original unbent condition, this action engages the edges 79 and 80 to retain the device in assembled condition. The device may be as readily disassembled for replacement of the picture by merely moving the flaps 60–64 outwardly to permit removal of the element 13.

Referring to FIG. 4 in the drawing, the device may be mounted upon a wall 81 or other vertical surface using double faced pressure sensitive adhesive tape 85, and removed when desired by merely overcoming the adhesive force. Because of the very low total weight of the assembled device, very little adhesive force is necessary, so that even where the surface of the wall is not entirely smooth, no difficulty is encountered in sustaining the weight of the device.

Turning now to the second embodiment of the invention, illustrated in FIGS. 5 to 9, inclusive, parts corresponding to those of the first embodiment have been designated by similar reference characters with the additional prefix 1.

Figure 6:
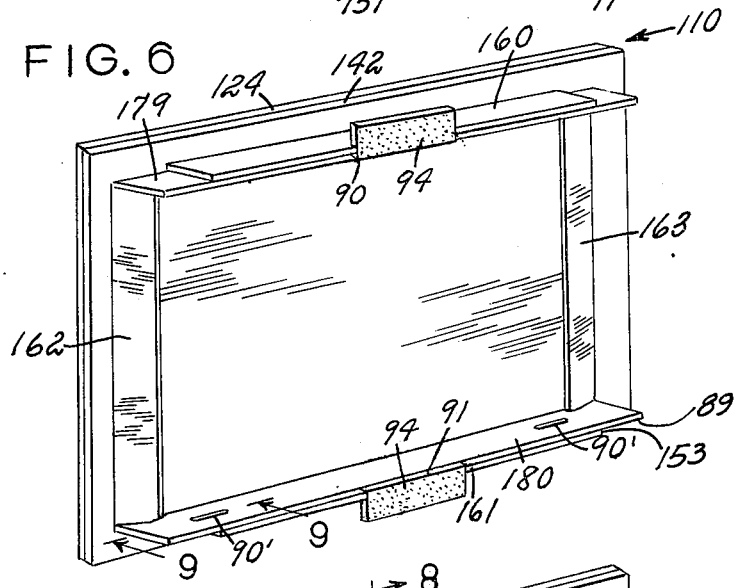
FIG. 6 is a similar view in perspective showing the device in assembled condition.
Figure 8:
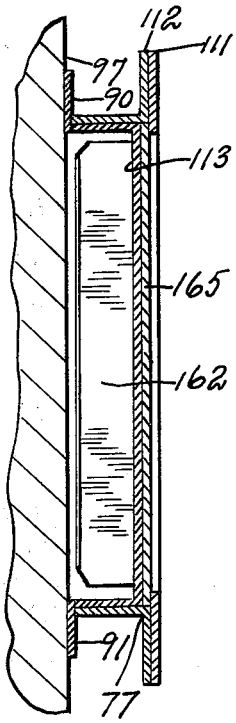
FIG. 8 is an enlarged vertical sectional view as seen from the plane 8—8 in FIG. 7, and showing the device in installed condition upon a vertical surface.
Figure 7:
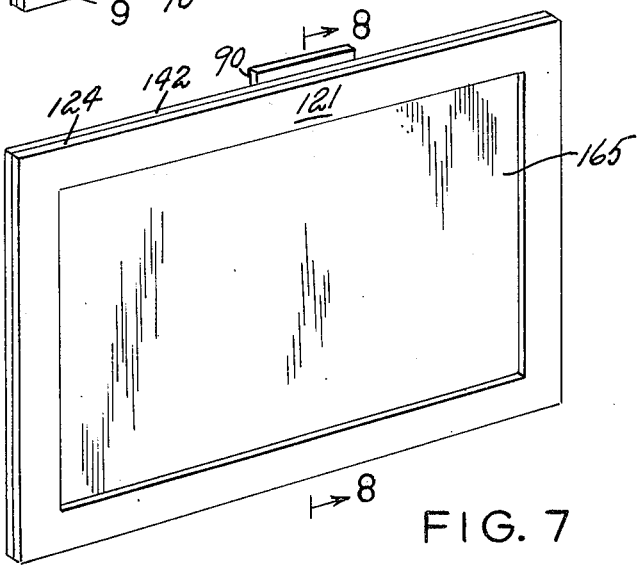
FIG. 7 is a view in perspective as seen from the rear of FIG. 6.
Figure 9:
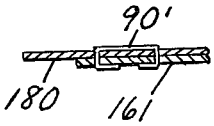
FIG. 9 is a fragmentary vertical sectional view as seen from the plane 9—9 in FIG. 6.

The second embodiment differs from the first embodiment in the modification of the edges 150, 151, 152 and 153 to inwardly spaced disposition with respect to the side edges of the device. Thus, the upper and lower flaps 160 and 161 are slightly shortened to provide small interstices 86, 87, 88 (FIG. 5) and 89 (FIG. 6). The flap 180 is secured by staples 90' to the flap 161 as a permanent interconnection, so that the device is opened with a swinging movement about the fold line 77, whereby the side flaps 162 and 163 are continuously captured when the device is opened, and need not be manually retracted to permit the picture retaining element 113 to be again placed in the position shown in FIGS. 6 and 7 after the insertion of a print. When the element 113 is fully seated, the side flaps resiliently return to an angular disposition shown in FIG. 6 to retain the element 113 in position.

Attaching tabs 90 and 91 may be either formed separately, or integrally with the flaps 179 and 180, as shown. Each tab includes an adhesive portion 94, the outer surface of which is provided with a suitable pressure sensitive adhesive (not shown). This may be protected by a removable protective cover (not shown) in well known manner, the removal of which permits the device to be adhered to the surface 97 of a vertical wall.

Turning now to the third embodiment of the invention, illustrated in FIGS. 10 to 14, inclusive, parts corresponding to those of the first embodiment have been designated by similar reference characters with the additional prefix 2.

The third embodiment differs from the first embodiment in the modification of the picture retaining element 213 to enable the device to be also used as an easel supported frame upon a horizontal supporting surface.

Thus, the element 213 is formed from a single blank 190 of material, and includes first and second parallel walls 191 and 192, respectively, interconnected on one side by a spacing wall 193 and overlapping walls 194 and 195 interconnected by cementitious means (not shown).

Each of the walls includes first and second tabs 100 and 101, respectively, which are bendable about fold lines 102 and 103 to interengage in well known manner whereby the device may be supported with the major axis either horizontal or vertical (see FIGS. 11 and 13). With the tabs 100 and 101 in mutally planar condition, the device may be mounted on a vertical surface using well known double faced adhesive tape strips 105, or, if desired, the device may be supported from a nail or picture hanger by engagement with an orifice 104.

I wish it to be understood that I do not consider the invention limited to the precise details of structure shown and set forth in this specification, for obvious modifications will occur to those skilled in the art to which the invention pertains.

I claim:

1. An improved picture frame construction for mounting photographic prints and the like comprising: a first planar frame element of generally rectangular configuration and defining a first rectangular through opening therein, said first frame element having rearward surface; a second planar frame element of overall size and configuration corresponding to that of said first frame element and having a peripheral portion joined in laminar relation to said rearward surface of said first frame element, said second frame element having a second rectangular through opening therein of larger dimensions than said first opening; whereby said second frame element partially overlies said rearward surface and leaves an exposed portion; said second frame element having a plurality of flaps foldably connected to said peripheral portion at the border of said second opening, and extending rearwardly from the plane thereof; and a third print-retaining element including a rectangular main body portion of size corresponding to that of said second opening, and selectively engaged between said exposed portion of said rearward surface of said first frame element and said flaps of said second frame element to be resiliently retained by the latter; said third element including a plurality of surfaces adapted to lie in congruent relation to said flaps on said second element.

2. Structure in accordance with claim 1, in combination with a photographic print positioned between said first and third elements, said print being of dimensions corresponding to said opening in said second element.

3. Structure in accordance with claim 1, further characterized in said third element including a plurality of peripherally arranged foldable flaps adapted to lie in congruent relation to said flaps on said second element.

4. Structure in accordance with claim 1, further characterized in said first and second element having at least one abutted heat-sealable surface of synthetic resinous material.

5. Structure in accordance with claim 4, including means for adhesively securing at least one of said flaps on said third element to a vertically oriented surface.

6. Structure in accordance with claim 1, including means for adhesively securing at least one of said flaps on said second element to a vertically oriented surface.

7. Structure in accordance with claim 1, further characterized in said third element including a pair of interconnected spaced parallel walls, at least one of which includes foldable tab means selectively forming an easel support for maintaining said construction in erect condition upon a horizontal surface.

8. Structure in accordance with claim 1, further characterized in said third element including a pair of interconnected spaced parallel walls, each including foldable tab means for selectively forming an easel support for maintaining said construction in erect condition upon a horizontal surface; said third element being selectively positionable with either wall in abutted relation relative to said second frame element, whereby said construction may be supported upon a horizontal surface with the major axis thereof positioned either horizontally or vertically.

9. Structure in accordance with claim 2, further characterized in said third element including a pair of interconnected spaced parallel walls, at least one of said walls having slots extending through the plane thereof, at least some of said flaps having tabs on free edges thereof selectively engaging said slots to positively lock said third element in position.

* * * * *